US010442997B2

(12) United States Patent
Narayanaswamy et al.

(10) Patent No.: US 10,442,997 B2
(45) Date of Patent: Oct. 15, 2019

(54) PLASTIC PYROLYSIS

(71) Applicant: SABIC Global Technologies B.V., Bergen op Zoom (NL)

(72) Inventors: Ravichander Narayanaswamy, Bangalore (IN); Krishna Kumar Ramamurthy, Bangalore (IN); Nicolas Goyheneix, Geleen (NL); Lara Galan-Sanchez, Geleen (NL)

(73) Assignee: SABIC Global Technologies B.V., Bergen op Zoom (NL)

( * ) Notice: Subject to any disclaimer, the term of this patent is extended or adjusted under 35 U.S.C. 154(b) by 0 days.

(21) Appl. No.: 15/636,785

(22) Filed: Jun. 29, 2017

(65) Prior Publication Data

US 2018/0002609 A1 Jan. 4, 2018

Related U.S. Application Data

(60) Provisional application No. 62/356,341, filed on Jun. 29, 2016.

(51) Int. Cl.
*C10G 1/10* (2006.01)
*C10G 1/02* (2006.01)
(Continued)

(52) U.S. Cl.
CPC ..... *C10G 1/10* (2013.01); *C10G 1/002* (2013.01); *C10G 1/02* (2013.01); *C10G 9/00* (2013.01);
(Continued)

(58) Field of Classification Search
CPC ..... C10G 1/00; C10G 45/00; C10G 47/00; C10G 1/10; C10G 1/08; B01J 19/00
See application file for complete search history.

(56) References Cited

U.S. PATENT DOCUMENTS 5,731,483 A * 3/1998 Stabel ..... B29B 13/022 208/130
8,895,790 B2 * 11/2014 Narayanaswamy ..... C10G 1/10 208/118
8,912,377 B2 * 12/2014 Kim ..... C10G 11/02 585/256

FOREIGN PATENT DOCUMENTS

EP 0726306 A1 8/1996
WO WO-2015128033 A1 * 9/2015 ..... C10G 70/00
(Continued)

OTHER PUBLICATIONS

Shah et al.; "Conversion of Waste Plastic to Oil: Direct Liquefaction versus Pyrolysis and Hydroprocessing"; Energy & Fuels; vol. 13; May 1999; p. 832-838 (abstract only).
(Continued)

*Primary Examiner* — Youngsul Jeong
(74) *Attorney, Agent, or Firm* — BakerHostetler

(57) ABSTRACT

Disclosed are methods of reduction of chlorine in pyrolysis products derived from a mixed plastics stream. Methods may comprise: (a) causing pyrolysis of a plastic feedstock to produce a first stream of C1-C4 gaseous hydrocarbons and light gas olefins and a second stream comprising the remaining pyrolysis components. The second stream and hydrogen gas may be fed into a hydrocracker to produce a third stream of gaseous C1-C4 hydrocarbon gases and a fourth stream comprising the remaining hydrocracker components. The fourth stream may be fed to either (i) a steam cracker to produce a fifth stream comprising C1-C4 gaseous hydrocarbons and light gas olefins, a sixth stream comprising C6-C8 hydrocarbons and a seventh stream comprising hydrocarbons heavier than C8; or (ii) a fluidized catalytic cracker to produce an eighth stream comprising C1-C4 gases and light gas olefins and a ninth stream comprising hydrocarbons that are C5 or greater.

14 Claims, 3 Drawing Sheets

(51) Int. Cl.

| | |
|---|---|
| ***C10G 9/00*** | (2006.01) |
| ***C10G 11/00*** | (2006.01) |
| ***C10G 1/00*** | (2006.01) |
| ***C10G 11/18*** | (2006.01) |
| ***C10G 47/12*** | (2006.01) |

(52) U.S. Cl.
CPC ..... *C10G 11/18* (2013.01); *C10G 47/12* (2013.01); *C10G 2400/20* (2013.01)

(56) References Cited

FOREIGN PATENT DOCUMENTS

| | | | |
|---|---|---|---|
| WO | WO 2016/142805 | A1 | 9/2016 |
| WO | WO 2016/142806 | A1 | 9/2016 |
| WO | WO 2016/142807 | A1 | 9/2016 |
| WO | WO 2016/142808 | A1 | 9/2016 |
| WO | WO 2016/142809 | A1 | 9/2016 |

OTHER PUBLICATIONS

Shiraga et al.; "Boiling-Point Distributions and Dechlorination of Organic Chlorine Compounds in Oil Obtained from the Degradation of PVC Mixed Plastic"; Energy & Fuels; vol. 13; p. 428-432 (abstract only).

* cited by examiner

PLASTIC PYROLYSIS

CROSS REFERENCE TO RELATED APPLICATION

The present application claims priority to U.S. application 62/356,341, filed Jun. 29, 2016, the entirety of which is incorporated herein by reference.

TECHNICAL FIELD

The instant disclosure concerns pyrolysis and reduction of chlorine from a plastics feedstock.

BACKGROUND

Waste plastic streams typically contain polyvinyl chloride (PVC). Through a pyrolysis process, waste plastics can be converted to gas and liquid products. These liquid products may contain paraffins, isoparaffins, olefins, naphthenes and aromatic components along with organic chlorides in hundreds of ppm. Pyrolysis liquids have a high olefin content and can be used as a feedstock for steam crackers partly replacing naphtha used in these units. Typically, the boiling end point of pyrolysis oil can be much higher than typical diesel fraction boiling end point. In order to feed the pyrolysis oil to steam cracker, it is necessary to dechlorinate the feed to reach very low concentrations of chlorine, saturate olefins in the liquid and have a boiling end point low enough to avoid possible fouling and corrosion in the process.

There is a need in the art for cost effective and carbon efficient processes to accomplish recycling of chlorine-containing plastic waste streams.

SUMMARY

The disclosure concerns methods of reduction of chlorine in pyrolysis products derived from a mixed plastics stream comprising: (a) causing pyrolysis of a plastic feedstock to produce a first stream comprising C1-C4 gaseous hydrocarbons and a second stream comprising hydrocarbons having 5 or more carbon atoms, wherein at least a portion of the plastic feedstock comprises chlorinated plastic; (b) feeding the second stream and hydrogen gas into a hydrocracker to produce a third stream comprising gaseous C1-C4 hydrocarbon gases and a fourth stream comprising hydrocarbons having 5 or more carbon atoms; and (c) feeding the fourth stream to either (i) a steam cracker to produce a fifth stream comprising C1-C4 gaseous hydrocarbons and light gas olefins, a sixth stream comprising C6-C8 hydrocarbons and a seventh stream comprising hydrocarbons having 8 or more carbon atoms; or (ii) a fluidized catalytic cracker to produce an eighth stream comprising C1-C4 gases, and a ninth stream comprising hydrocarbons having 5 or more carbon atoms.

In some aspects, the disclosure concerns integrated system comprising: a pyrolysis unit capable of pyrolysis of plastic feedstock to produce a first stream comprising C1-C4 gaseous hydrocarbons and a second stream comprising hydrocarbons having at least 5 carbon atoms, wherein at least a portion of said plastic feedstock comprises chlorinated plastic; a hydrocracker capable of producing a third stream comprising gaseous C1-C4 gases and a fourth stream comprising hydrocarbons having at least 5 carbon atoms; and either (i) a steam cracker capable of producing a fifth stream comprising C1-C4 gaseous hydrocarbons and light gas olefins, a sixth stream comprising C6-C8 hydrocarbons and a seventh stream comprising hydrocarbons having at least 9 carbon atoms; or (ii) a fluid catalytic convertor capable of producing an eighth stream comprising C1-C4 gases and a ninth stream comprising hydrocarbons having at least 5 carbon atoms.

DETAILED DESCRIPTION OF ILLUSTRATIVE ASPECTS

The present disclosure can be understood more readily by reference to the following detailed description of the disclosure and the Examples included therein.

The disclosure concerns an integrated process configuration involving the steps of pyrolysis, hydrocracking and steam cracking with or without fluidized catalytic cracking (FCC) for maximizing light gas olefins (i.e., unsaturated C1-C4 hydrocarbon including a double bond) and forming mono-ring aromatics in C6-C8 range as a by-product. Pyrolysis oil is subject to hydrocracking to saturate the pyrolysis oil completely. The hydrocracked product is then subjected to: a) splitting a C6-C8 fraction and feeding to steam cracker with the heavier products (greater than C8) being either recycled back to hydrocracker feed or fed to a high severity FCC unit or b) feeding to high severity FCC unit for improved yields of light gas olefins (including propylene) and aromatics (steam cracker not used in this case). High severity FCC may refer to a down flow reactor system (i.e., the catalyst and feed flow downwards with gravity through a reactor) or a riser reactor (i.e. the catalyst and feed flowing upwards), high reaction temperature (i.e., 550° C. to 650° C.), short residence/contact time (less than 2-3 seconds), and high catalyst-to-oil (C/O) ratio. All gases from process units (hydrocracker, pyrolysis or FCC) would feed the cracker downstream separation section after scrubbing out acid gases.

In some aspects, a mixed plastics feed stream is fed to a pyrolysis reactor producing first stream comprising gaseous C1-C4 hydrocarbons and a liquid second stream comprising higher molecular weight hydrocarbons. The second stream and hydrogen gas are introduced into a hydrocracker to produce a third stream of gaseous C1-C4 hydrocarbon gases and a fourth stream comprising the remaining hydrocracker components. The fourth stream is fed to either (i) a steam cracker to produce a fifth stream comprising C1-C4 gaseous hydrocarbons and light gas olefins, a sixth stream comprising C6-C8 hydrocarbons and a seventh stream comprising hydrocarbons heavier than C8; or (ii) a fluidized catalytic cracker to produce an eighth stream comprising C1-C4 gases, a ninth stream comprising hydrocarbons that are C5 or greater. Several possible process variations are illustrated by FIGS. 1-3.

Figure 1:
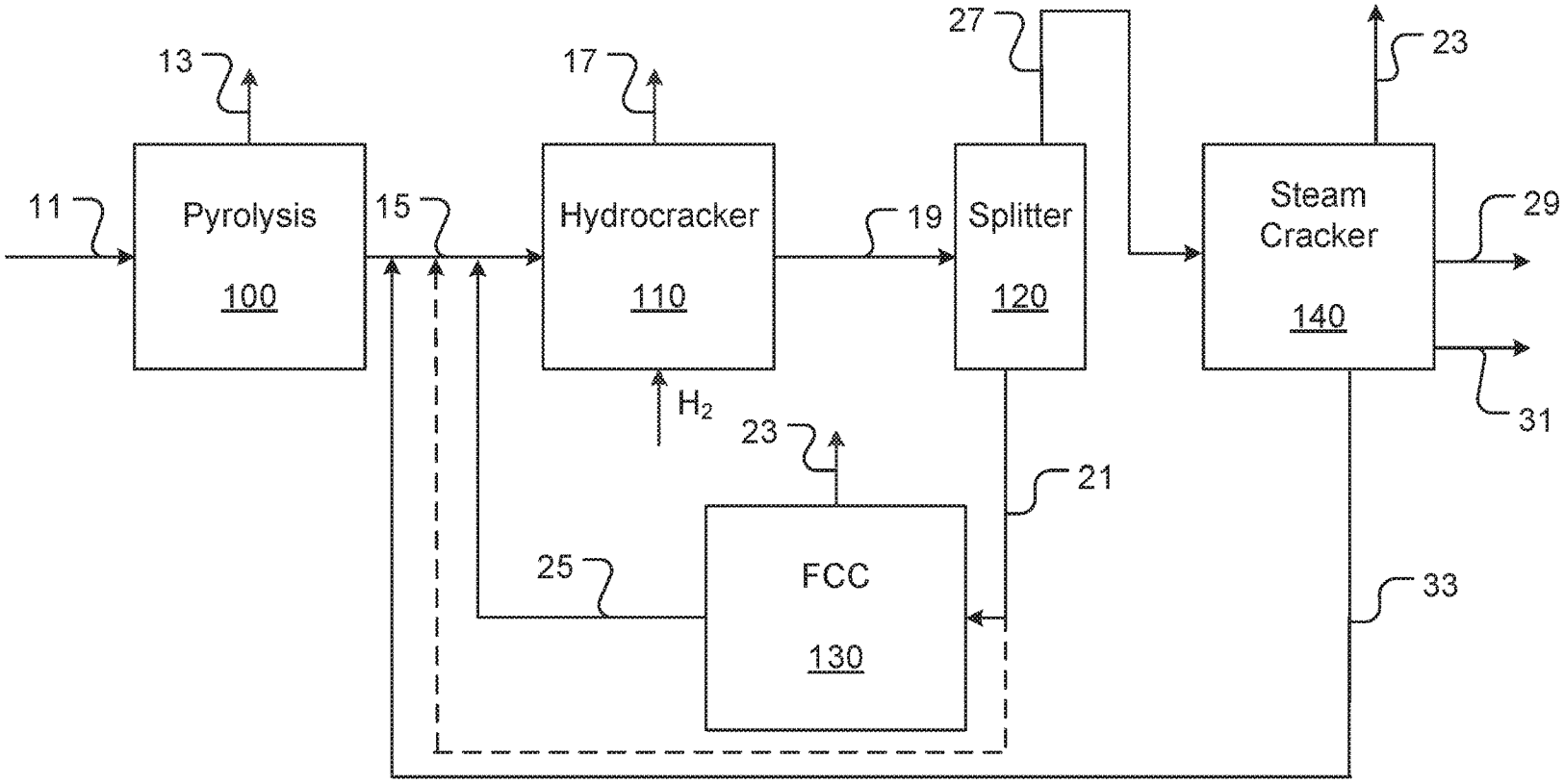
FIG. 1 illustrates a process configuration utilizing a pyrolysis step, hydrocracker, distillation column, a steam cracker and a fluidized catalytic cracker to process a mixed plastics stream to maximize light gas olefins and produce some by-product mono-ring aromatics.

FIG. 1 illustrates a process that maximizes light gas olefins and produces some by-product mono-ring aromatics. A mixed plastics feed stream 11 is fed to a pyrolysis reactor 100 producing first stream 13 comprising gaseous C1-C4 hydrocarbons and a liquid second stream 15 comprising higher molecular weight hydrocarbons. The second stream and hydrogen gas are introduced into a hydrocracker 110 to produce a third stream 17 of gaseous C1-C4 hydrocarbon gases and a fourth stream 19 comprising the remaining hydrocracker components. The fourth stream is supplied to a distillation column (splitter 120) that produces (i) a bottom stream 21 comprising hydrocarbons heavier than C8 to a fluid catalytic cracker 130, the fluidized catalytic cracker 130 producing a C1-C4 gaseous hydrocarbon stream 23 and a heavies stream 25, the heavies stream 25 being recycled to the hydrocracker 110 and (ii) a top stream 27 comprising hydrocarbons that are C8 and lighter to a steam cracker 140 producing a fifth stream 29 comprising C1-C4 gaseous hydrocarbons and light gas olefins, a sixth stream 31 comprising C6-C8 hydrocarbons and a seventh stream 33 comprising hydrocarbons heavier than C8. The bottom stream 21 and top stream 27 may refer to the orientations of the stream based upon the weight of their constituents, i.e., a heavies stream comprising hydrocarbons heavier than C8 (bottom stream 21) and a stream comprising C8 and lighter (top stream 27).

Figure 2:
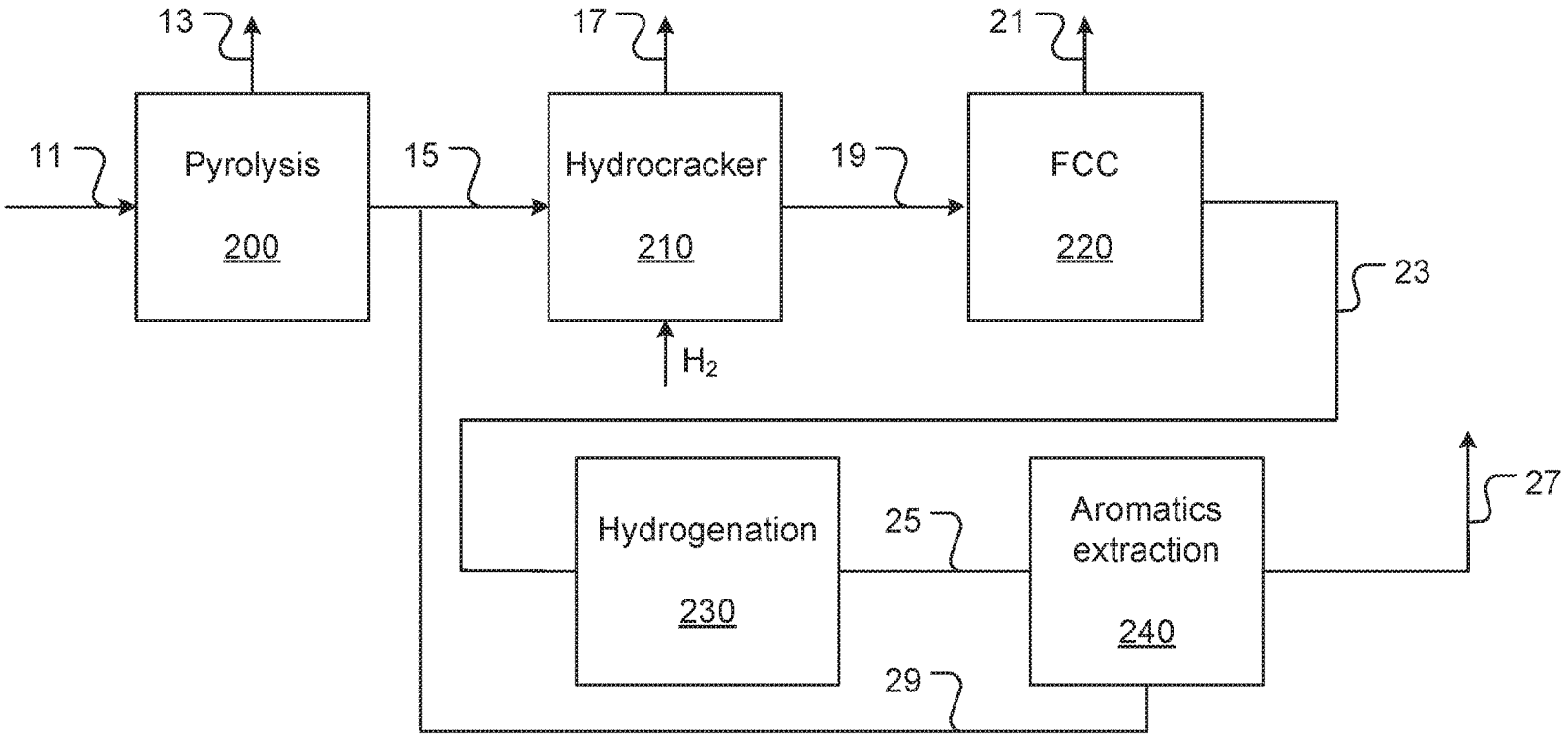
FIG. 2 illustrates a process configuration utilizing a pyrolysis step, hydrocracker, a fluidized catalytic cracker, a hydrogenation unit and an aromatic extraction unit to process a mixed plastics stream to maximize both light gas olefins (especially propylene) and C6-C8 aromatics.

FIG. 2 illustrates a process for maximizing both light gas olefins (especially propylene) and C6-C8 aromatics. A mixed plastics feed stream 11 is fed to a pyrolysis reactor 100 producing a first stream 13 comprising gaseous C1-C4 hydrocarbons and a liquid second stream 15 comprising higher molecular weight hydrocarbons. The second stream 15 and hydrogen gas are introduced into a hydrocracker to produce a third stream 17 of gaseous C1-C4 hydrocarbon gases and a fourth stream 19 comprising the remaining hydrocracker components. The fourth stream 19 is fed to the fluidized catalytic cracker 220 producing an eight stream 21 comprising C1-C4 gases and a sixth stream 23 comprising hydrocarbons that are C5 or greater, the ninth stream being 23 supplied to a hydrogenation reactor 230 to produce a tenth stream 25 comprising hydrogenated product, the hydrogenated product being supplied to an aromatic extraction unit 240 to produce a C6-C8 aromatics stream 27 and a stream 29 comprising hydrocarbons heavier than C8 that is recycled to the hydrocracker.

Figure 3:
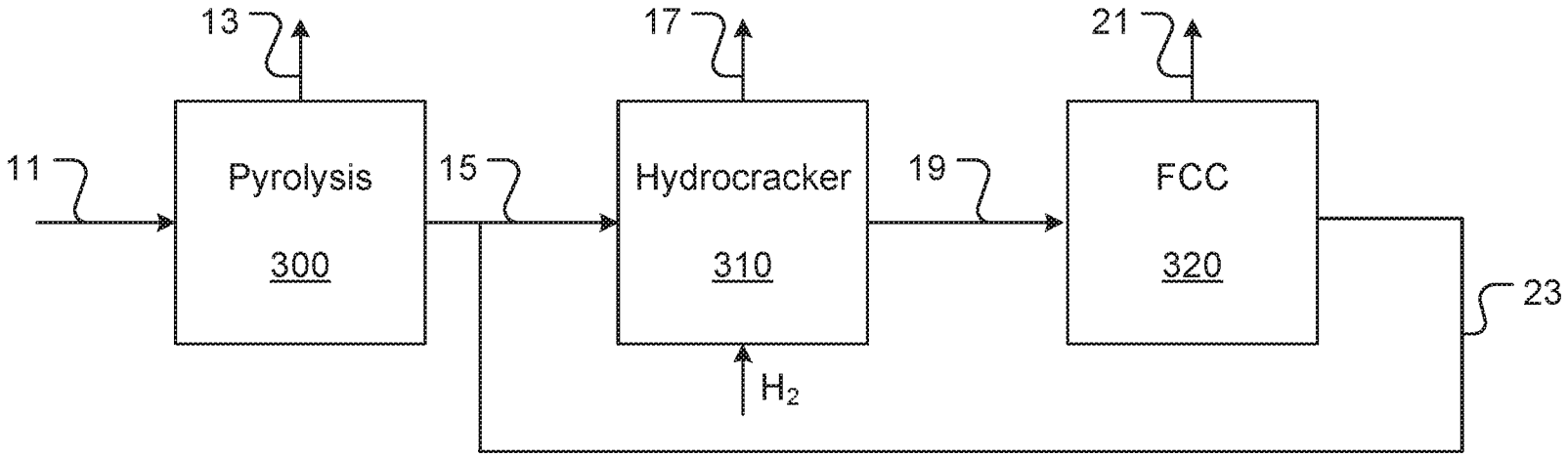
FIG. 3 illustrates a process configuration utilizing a pyrolysis step, hydrocracker, and a fluidized catalytic cracker to process a mixed plastics stream to maximize light gas olefin (especially propylene) production.

FIG. 3 presents a schematic for production of light gas olefins (especially propylene) and essentially does not produce any other by product. A mixed plastics feed stream 11 is fed to a pyrolysis reactor 300 producing first stream 13 comprising gaseous C1-C4 hydrocarbons and a liquid second stream 15 comprising higher molecular weight hydrocarbons. The second stream 15 and hydrogen gas are introduced into a hydrocracker 310 to produce a third stream 17 of gaseous C1-C4 hydrocarbon gases and a fourth stream 19 comprising the remaining hydrocracker components. The fourth stream 19 is fed to the fluidized catalytic cracker 320 producing an eighth stream 21 comprising C1-C4 gases and a ninth stream 23 comprising hydrocarbons that are C5 or greater, the ninth stream 23 being recycled to the hydrocracker 310.

In some aspects, the plastic feedstock comprises at least 1000 parts per million (ppm) of chloride. In some preferred aspects, at least one of the sixth and ninth streams comprises less than 1 ppm of chloride.

Plastic Feed

The mixed plastic feed used in the conversion reaction may include essentially all plastic materials. Non-limiting examples include polyolefins, such as polyethylene and polypropylene, polystyrene, polyethylene terephthalate (PET), polyvinyl chloride (PVC), polyvinylidene chloride (PVDC), polyamide, polycarbonate, polyurethane, polyester, natural and synthetic rubber, tires, filled polymers, composites and plastic alloys, and plastics dissolved in a solvent. The processes described herein are particularly useful for processing chlorine containing plastics feed mixtures. While plastic feeds may be used in the conversion reaction, other hydrocarbon materials may also be used as the feedstock. These hydrocarbons may include biomass, bio-oils, petroleum oils, and the like. Thus, while the present description is directed primarily to the conversion of plastic feeds, it should be understood that the disclosure has applicability to and encompasses the use of other hydrocarbons as well. When production of light gas olefins is desired, a plastic feed of polyolefins or that is primarily or contains a substantial portion of polyolefins may be preferred. Mixtures of various different plastic and hydrocarbon materials may be used without limitation.

The mixed plastic feed may be provided in a variety of different forms. In smaller scale operations, the plastic feed may be in the form of a powder. In larger scale operations, the plastic feed may be in the form of pellets, such as those with a particle size of from 1 to 5 millimeter (mm).

Pyrolysis

Solid mixed plastics are fed to the pyrolysis reactor and are converted to gaseous and liquid products. Some of the feed is also converted to coke in the pyrolysis unit that is not shown in the figures. The pyrolysis unit used can be a low severity (temperature less than or equal to 450° C.) or a high severity pyrolysis (temperature greater than 450° C.). The reactor used can be of different types and are not limiting for the purpose of this disclosure. Typical reactor types that can be used are tank reactors, rotary kilns, packed beds, bubbling and circulating fluidized bed and others. The gas products from the pyrolysis zone would contain hydrochloric acid HCl apart from hydrogen and hydrocarbon gases, carbon monoxide CO, carbon dioxide $CO_2$ and other acid gases. The gases are scrubbed for removing CO, $CO_2$, other acid gases and HCl before feeding to steam cracker immediately downstream of the cracking furnace or for using for any other purpose. As used herein, scrubbing may refer to liquid scrubbing processes as well as reactive adsorption processes. Reactive adsorption scrubbing processes may include, for example, use of a calcium oxide bed in the fixed reactor to remove gases and HCl. A liquid scrubbing process may include a process of combining with an alkaline solution to remove HCl.

Polyvinyl chloride (PVC) and other chloride containing polymers in the feed when converted in the pyrolysis zone would liberate HCl. The pyrolysis reaction can be achieved in a single or multiple stages and can involve devolitization (devol) extruders and gas purging of the pyrolysis melt to help in liberation of chloride species from the pyrolysis liquid. The pyrolysis reaction can be thermal, catalytic or a combination of both and can involve use of sand, other inert material, catalysts and any combination of these. The catalysts may be selected from among various zeolites, aluminas or other catalytic material having catalytic cracking activity. It can involve a single catalyst or a combination of one, two or more catalysts. See, for example U.S. Pat. No. 8,895,790.

Crackers

Cracking is the process where compounds such as heavy (high molecular weight and/or high boiling) hydrocarbons are broken down into smaller molecules such as light hydrocarbons. This is accomplished by breaking carbon-carbon bonds to form smaller molecules. The composition of the product of a cracking unit is strongly dependent on the temperature the unit is operated at and presence of catalysts. Steam crackers and fluid cracker are commonly used crackers. Typically, fluid catalytic crackers (FCC) are used to produce gasoline and liquefied petroleum gas LPG, while hydrocracking is a major source of jet fuel, diesel fuel, naphtha, and LPG. Steam crackers are primarily used to produce ethylene. Operation of these different types of crackers is known to those skilled in the art.

Steam crackers, such as in FIG. 1, may include one or more of a cracking furnace, gas and liquid separations units and an aromatics extraction unit.

Hydrocracking

The pyrolysis oil product from the pyrolysis section is fed to the hydrocracking section. The hydrocracker saturates the pyrolysis oil and feeds it to a downstream unit. Catalysts are commercially available hydrocracking catalysts like cobalt-molybdenum Co—Mo oxides, nickel-molybdenum Ni—Mo oxides and tungsten-molybdenum W—Mo oxides on alumina substrate or metal loaded zeolites, sulfides of these catalysts, or any combination of these. In addition, catalysts that are formed in-situ are also suitable catalysts. While fixed bed reactors are sufficient from the perspective of hydrocracking activity desired, it is also possible to involve more severe operations involving ebullated and slurry reactors. The products from the hydrocracker are gas and liquid products. The gas products are scrubbed to remove chlorides and then fed to immediately downstream of steam cracking furnace.

Fluidized Catalytic Cracking

Some processes use a high severity operation FCC unit capable of operating at high conversions to light gas olefins. One example of the catalyst used in such system could be that disclosed in U.S. Pat. No. 8,895,790.

The process utilizes fluidized catalytic cracking (FCC) catalysts and a zeolite socony mobil-5 ZSM-5 (an aluminosilicate zeolite) catalyst additive that are used in combination with one another in a catalyst composition to facilitate the pyrolytic conversion of the plastic or hydrocarbon feed. The FCC catalysts are those useful in the cracking of petroleum feeds. Such petroleum feeds may include vacuum gas oil (350-550° C. boiling range), atmospheric gas oil and diesel (220° C.-370° C. boiling range), naphtha (less than 35° C. to 220° C. boiling range) or residues (boiling at greater than 550° C. range) from a crude oil atmospheric and vacuum distillation units or the various such streams generated from all secondary processes in refineries including hydrotreating, hydrocracking, coking, visbreaking, solvent deasphalting, fluid catalytic cracking, naphtha reforming and such or their variants. The FCC catalysts are typically composed of large pore molecular sieves or zeolites. Large pore zeolites are those having an average pore size of from 7 Ångström (Å) or more, more typically from 7 Å to about 10 Å. Suitable large pore zeolites for FCC catalysts may include X-type and Y-type zeolites, mordenite (zeolite mineral of $(Ca, Na_2, K_2)Al_2Si_{10}O_{24}.7H_2O$) and faujasite (zeolite mineral of formula $(Na_2, Ca, Mg)_{3.5}[Al_7SiO_{48}].32(H_2O)$), nano-crystalline Zeolites, MCM (Mobil Composition of Matter) mesoporous materials (MCM-41, MCM-48, MCM-50 and other mesoporous materials), microporous silica (such as SBA-15, Santa Barbara Amorphous type material) and silico-alumino phosphates, gallophosphates, titanophosphates. Particularly useful are Y-type zeolites.

In Y-type zeolites used for FCC catalysts, the silica and alumina tetrahedral are connected by oxygen linkages. In order to impart thermal and hydrothermal stability, the Y-zeolite may be subjected to treatment to knock off some framework alumina (one of these routes is steaming at high temperature). Typically Y-zeolites have silicon/aluminum (Si/Al) ratio of about 2.5:1. The dealuminated Y-zeolite typically has a Si/Al ratio of 4:1 or more. The dealuminated Y-zeolite, with a higher framework Si/Al ratio, has stronger acid sites (isolated acid sites) and is thermally and hydrothermally more stable and is thus called ultrastable Y-zeolite (USY-zeolite). In units like fluid catalytic cracking where the catalysts see temperatures of 700° C. and also moisture in a catalyst regenerator, the thermal and hydrothermal stability is important so that catalyst activity is maintained over a longer period of time. Hence, in such types of operation USY-zeolite may be the preferred FCC catalyst.

The ultrastable zeolites may also be rare-earth-exchanged. The rare-earth content may be higher than 0% and may be as high as 10% by weight of the zeolite, with from 0.1-3% by weight of zeolite being typical. The higher the rare earth content, however, the more olefinicity of the products is lost by favoring hydrogen transfer reactions to make paraffins. Some amount of rare earth in the zeolite Y may be useful because it imparts stability to the zeolite. The rare earth materials may comprise cerium, lanthanum and other rare earth materials.

Steam Cracking

The products from the steam cracker section comprise light gas olefins and C6-C8 aromatics. Heavier liquid products from steam cracker, if any, may be fed to an upstream hydrocracker.

In steam cracking, a gaseous or liquid hydrocarbon feed is mixed with steam and heated in the absence of oxygen. The reaction may typically proceed at high temperature and short time frame. The products produced in the reaction depend on several factors including the feed stream composition, the hydrocarbon to steam ratio, reactor temperature and the time the feedstock is exposed to heating.

Use of higher cracking temperatures) favors the production of ethylene and benzene. Lower temperatures typically yield higher amounts of propene, C4-hydrocarbons and liquid products.

Operation of steam crackers is well known to those skilled in the art.

Splitter

The splitter comprises a distillation column to separate a C5-C8 cut from the feed entering the splitter column and feed it to downstream units. Any suitable distillation column may be used. Such columns are known to those skilled in the art.

Hydrogenation

Hydrogenation may be performed using a fixed bed reactor with known hydrogenation catalysts—many of which are commercially available. In some aspects the hydrogenation reactor is equivalent or the same as current state-of-art in steam crackers.

Aromatic Extraction

Commercially available technologies may be used for this step.

Definitions

It is to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural equivalents unless the context clearly dictates otherwise. Thus, for example, reference to "a polycarbonate polymer" includes mixtures of two or more polycarbonate polymers.

As used herein, the term "combination" is inclusive of blends, mixtures, alloys, reaction products, and the like.

Ranges can be expressed herein as from one value (first value) to another value (second value). When such a range is expressed, the range includes in some aspects one or both of the first value and the second value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the designated value, approximately the designated value, or about the same as the designated value. It is generally understood, as used herein, that it is the nominal value indicated ±5% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

"T" stands for temperature.

° C." is degrees Celsius.

"P" stands for pressure.

"ppmw" is an abbreviation of parts per million weight (parts per million on a weight basis rather than a volume basis).

"bar(g)" and "barg" stands for gauge pressure.

"WHSV" is weight hourly space velocity.

When a hydrocarbon stream is described as having a certain carbon number (C5, for example) or greater, it defines a mixture comprising hydrocarbons having that the certain number of carbons per molecule or more than that number of carbons per molecule. For example, hydrocarbons that are C5 or greater, may comprise C5, C6, C7, C8 and higher molecular weight hydrocarbons.

"C1-C4 gases" comprise one or more of hydrogen, methane, ethane, ethane, propane, propene, butane and i-butane. The C3 and C4 compounds can be linear or branched.

"Light gas olefins" typically comprise ethylene, propylene, butenes and butadienes.

"C6-C8 hydrocarbons" can comprise saturated hydrocarbons and/or aromatic hydrocarbons.

"C6-C8 aromatic hydrocarbons" comprise one or more of benzene, toluene, ethylbenzene, styrene and xylenes.

"Xylenes" comprise one or more of 1,2-dimethylbenzene, 1,3-dimethylbenzene and 1,4-dimethylbenzene.

As used herein, the term "hydrocarbyl" and "hydrocarbon" refers broadly to a substituent comprising carbon and hydrogen, optionally with 1 to 3 heteroatoms, for example, oxygen, nitrogen, halogen, silicon, sulfur, or a combination thereof "Alkyl" refers to a straight or branched chain, saturated monovalent hydrocarbon group. "Alkylene" refers to a straight or branched chain, saturated, divalent hydrocarbon group.

"Heavies" comprise high molecular weight/high boiling products. In some aspects, heavies comprise hydrocarbons having more than 8 carbon atoms.

"Chlorinated plastic" comprises organic plastic material comprising covalently bonded chlorine atoms. Polyvinyl chloride (PVC) and polyvinylidene chloride (PVDC) are commonly used chlorinated plastics.

"ZSM-5" is an aluminosilicate zeolite belonging to the pentasil family of zeolites. Its chemical formula is $Na_nAl_nSi_{96-n}O_{192}.16H_2O$ ($0<n<27$).

"BTX" refers to mixtures of benzene, toluene, and xylene isomers.

"EB" refers to ethylbenzene.

Aspects

The present disclosure comprises at least the following aspects.

Aspect 1. A method of reduction of chlorine in pyrolysis products derived from a mixed plastics stream comprising: (a) causing pyrolysis of a plastic feedstock to produce a first stream of C1-C4 gaseous hydrocarbons and light gas olefins and a second stream comprising hydrocarbons having 5 or more carbon atoms, wherein at least a portion of the plastic feedstock comprises chlorinated plastic; (b) feeding the second stream and hydrogen gas into a hydrocracker to produce a third stream of gaseous C1-C4 hydrocarbon gases and a fourth stream comprising hydrocarbons having 5 or more carbon atoms; and (c) feeding the fourth stream to either: (i) a steam cracker to produce a fifth stream comprising C1-C4 gaseous hydrocarbons and light gas olefins, a sixth stream comprising C5-C8 hydrocarbons and a seventh stream comprising hydrocarbons having 8 or more carbon atoms; or (ii) a fluidized catalytic cracker to produce an eighth stream comprising C1-C4 gases and light gas olefins, a ninth stream comprising hydrocarbons having 5 or more carbon atoms.

Aspect 2. The method of Aspect 1, wherein the feeding the fourth stream comprises feeding to a distillation column, wherein the distillation column supplies a bottom stream comprising hydrocarbons heavier than C8 to a fluid catalytic cracker, the fluidized catalytic cracker producing a C1-C4 gaseous hydrocarbon stream and light gas olefins and a stream comprising hydrocarbons having 5 or more carbon atoms, the stream comprising hydrocarbons having 5 or more carbon atoms being recycled to the hydrocracker, and wherein the distillation column supplies a top stream comprising hydrocarbons that have 8 or fewer carbon atoms to the steam cracker, the steam cracker producing the fifth stream, the sixth stream, and the seventh stream.

Aspect 3. The method of Aspect 1, wherein the feeding the fourth stream comprises feeding to the fluidized catalytic cracker producing the eighth stream and the ninth stream, the ninth stream being recycled to the hydrocracker.

Aspect 4. The method of Aspect 1, wherein the feeding the fourth stream comprises feeding to the fluidized catalytic cracker producing the eighth stream and the ninth stream, the ninth stream being supplied to a hydrogenation reactor to produce a tenth stream comprising hydrogenated product, the hydrogenated product being supplied to an aromatic extraction unit to produce a C6-C8 aromatics stream and a stream comprising hydrocarbons having at least 9 carbon atoms that is recycled to the hydrocracker.

Aspect 5. The method of any one of Aspects 1-4, wherein the mixed plastic feedstock comprises at least one of polyolefins, polyethylene, polypropylene, polystyrene, polyethylene terephthalate (PET), polyvinyl chloride (PVC), polyamide, polycarbonate, polyurethane, polyester, natural and synthetic rubber.

Aspect 6. The method of any one of Aspects 1-5, wherein at least one of the first stream, third stream, fifth stream and eighth stream additionally comprises HCl.

Aspect 7. The method of Aspect 6, wherein the HCl is scrubbed from at least one of the first stream, third stream, fifth stream and eighth stream.

Aspect 8. The method of any one of Aspects 1-7, wherein the pyrolysis is performed in the presence of a catalyst in a low severity or high severity pyrolysis.

Aspect 9. The method of any one of Aspects 1-8, wherein the hydrocracker is a fixed bed reactor and the reaction in the hydrocracker is in the presence of a catalyst.

Aspect 10. The method of any one of Aspects 1-9, wherein the fluidized catalytic cracker operates at a temperature of 550° C. or higher, in the presence of a catalyst composition comprising a fluidized catalytic cracking catalyst and a ZSM-5 zeolite catalyst, wherein the amount of ZSM-5 zeolite catalyst makes up at least 10 wt. % of the total weight of the FCC catalyst and the ZSM-5 zeolite catalyst, the fourth stream and the catalyst composition being at a catalyst-to-feed stream ratio of from 6 or greater.

Aspect 11. The method of Aspect 10, wherein the fluidized catalytic cracking catalyst is comprised of at least one of an X-zeolite, a Y-zeolite, a USY-zeolite, mordenite, faujasite, nano-crystalline zeolites, MCM mesoporous materials, microporous silica, a silico-alumino phosphate, a gallophosphate, and a titanophosphate.

Aspect 12. The method of any one of Aspects 1-11, wherein fourth stream contains 10 ppm or less of chloride when fed to the steam cracker.

Aspect 13. The method of any one of Aspects 1-12, wherein the plastic feedstock comprises at least 1000 ppm of chloride.

Aspect 14. The method of any one of Aspects 1-13, wherein at least one of the sixth and ninth streams comprises less than 1 ppm of chloride.

Aspect 15. An integrated system comprising: a pyrolysis unit capable of pyrolysis of plastic feedstock to produce a first stream comprising C1-C4 gaseous hydrocarbons and light gas olefins and a second stream comprising hydrocarbons having at least 5 carbon atoms, wherein at least a portion of the plastic feedstock comprises chlorinated plastic; a hydrocracker capable of producing a third stream comprising gaseous C1-C4 gases and a fourth stream comprising hydrocarbons having at least 5 carbon atoms from the second stream; and either (i) a steam cracker capable of producing a fifth stream comprising C1-C4 gaseous hydrocarbons and light gas olefins, a sixth stream comprising C6-C8 hydrocarbons and a seventh stream comprising hydrocarbons having at least 9 carbon atoms from the fourth stream; or (ii) a fluid catalytic convertor capable of producing an eighth stream comprising C1-C4 gases and light gas olefins, a ninth stream comprising hydrocarbons having at least 5 carbon atoms from the fourth stream.

Aspect 16. The integrated system of Aspect 1, wherein the fluidized catalytic cracker operates at a temperature of 550° C. or higher, in the presence of a catalyst composition comprising a fluidized catalytic cracking catalyst and a ZSM-5 zeolite catalyst, wherein the amount of ZSM-5 zeolite catalyst makes up at least 10 wt. % of the total weight of the FCC catalyst and the ZSM-5 zeolite catalyst, the fourth stream and the catalyst composition being at a catalyst-to-feed stream ratio of from 6 or greater.

Aspect 17. The integrated system of Aspect 16, wherein the fluidized catalytic cracking catalyst is comprised of at least one of an X-zeolite, a Y-zeolite, a USY-zeolite, mordenite, faujasite, nano-crystalline zeolites, MCM mesoporous materials, microporous silica, a silico-alumino phosphate, a gallophosphate, and a titanophosphate.

Aspect 18. An integrated system comprising: a pyrolysis unit capable of pyrolysis of plastic feedstock to produce a first stream of C1-C4 gaseous hydrocarbons and light gas olefins and a second stream comprising hydrocarbons having at least 5 carbon atoms, wherein at least a portion of the plastic feedstock comprises chlorinated plastic; a hydrocracker capable of producing a third stream of gaseous C1-C4 gases and a fourth stream comprising hydrocarbons having at least 5 carbon atoms from the second stream; and a fluid catalytic cracker capable of producing an eighth stream comprising C1-C4 gases and light gas olefins, a ninth stream comprising hydrocarbons having at least 5 carbon atoms from the fourth stream wherein the ninth stream is recycled back to the hydrocracker.

Aspect 19. The integrated system of aspect 18, wherein the fluidized catalytic cracking catalyst is comprised of at least one of an X-zeolite, a Y-zeolite, an ultrastable Y-type (USY)-zeolite, mordenite, faujasite, nano-crystalline zeolites, MCM mesoporous materials, microporous silica, a silico-alumino phosphate, a gallophosphate, and a titanophosphate.

EXAMPLES

The disclosure is illustrated by the following non-limiting examples.

Pyrolysis Examples

Example 1

Example 1 shows a high severity operation for the pyrolysis unit. An amount of 1.5 grams (g) of plastics feed and 9 g of catalyst mixture having a composition comprised of 37.5 wt. % ZSM-5 catalyst, with the remainder being spent FCC catalyst, were used in pyrolysis conversions in a fluidized bed reactor. Details regarding the experimental facility for Example 1 are described in U.S. Patent Publication No. 2014/0228606A1, which is incorporated herein by reference in its entirety. The mixed plastics feed had the following composition as presented in Table 1.

TABLE 1

Mixed plastics feed composition.

| Material | Amount, wt % |
|---|---|
| HDPE | 19 |
| LDPE | 21 |
| PP | 24 |
| $C_4$-LLDPE | 12 |
| $C_6$-LLDPE | 6 |
| PS | 11 |
| PET | 7 |

HDPE refers to high density polyethylene (HDPE, for example, a density of about 0.93 to 0.97 grams per cubic centimeter (g/cm$^3$) or 970 kilograms per cubic meter (kg/m$^3$)), LDPE refers to low density polyethylene (for example, about 0.910 g/cm$^3$ to 0.940 g/cm$^3$), LLDPE is linear low density polyethylene (LLDPE), PS is polystyrene, and PET is polyethylene terephthalate.

The reaction temperature at start of reaction was 670° C. The one-minute average bed temperatures achieved was 569.6° C. The Catalyst/Feed (C/F) ratio was 6. Fluidization nitrogen $N_2$ gas flow rate used was 175N cubic centimeters per minute (cc/min). Overall aromatic and liquid i-paraffin product yields and aromatic and liquid i-paraffin content in liquid product boiling below 240° C. were 31.6 wt % and 5.76 wt %, respectively. Their respective concentrations in the liquid product boiling below 240° C. was 74.72 wt % and 13.22 wt %. The yield of light gas olefins, i.e., the sum of yields of ethylene, propylene and butenes was 32.69 wt %, and the total yield of gas products was 45.17 wt %.

A detailed hydrocarbon analysis (DHA) was performed for the liquid product boiling below 240° C. and the results are presented in Table 2.

TABLE 2

DHA for liquid boiling product below 240° C.

| Carbon No. | n-Paraffins, wt % | i-Paraffins, wt % | Olefins, wt % | Naphthenes, wt % | Aromatics, wt % | Total, wt % |
|---|---|---|---|---|---|---|
| 5 | 0.013 | 0.02 | 0.169 | 0.031 | | 0.233 |
| 6 | 0.101 | 0.219 | 1.031 | 0.318 | 5.28 | 9.113 |
| 7 | 0.254 | 1.243 | 2.267 | 0.665 | 17.188 | 21.618 |
| 8 | 0.544 | 2.703 | 0.354 | 1.125 | 30.339 | 35.066 |
| 9 | 0.22 | 3.98 | 0.107 | 1.44 | 10.95 | 16.70 |
| 10 | 0.12 | 2.07 | | 0.217 | 3.89 | 6.30 |
| 11 | 0.10 | 2.53 | | 0.299 | 1.53 | 4.39 |
| 12 | 0.05 | 0.46 | | | 3.37 | 3.88 |
| 13 | 0.03 | | | | | 0.03 |
| Unknown | | | | | | 2.69 |
| Total, wt % | 1.42 | 13.22 | 3.928 | 4.03 | 74.72 | 97.32 |
| Total, wt % on Aromatics-Free Basis | 6.3 | 58.5 | 17.4 | 17.8 | | |

The yield of heavy products boiling above 370° C. was 0.86 wt %.

Example 2

Example 2 shows a high severity operation for the pyrolysis unit, operated in a hydrogen-assisted hydropyrolysis mode. An amount of 1.5 g of mixed plastics was mixed with 9 g of a catalyst mixture comprising 62.5 wt % spent FCC catalyst and 37.5 wt % ZSM-5 zeolite catalyst. The combined mixture was then fed to the fluidized bed reactor described in Example 1. The plastic feed was in the form of a 200 micron plastic powder. A mixture of 10% hydrogen $H_2$ in $N_2$ was employed as the carrier gas at a flow rate of 175 N cc/min.

Studies were conducted by maintaining the reactor bed temperature, before feed and catalyst mixture was introduced, at 600° C., 635° C., and 670° C., respectively, i.e., at 3 different starting temperatures. Studies were also conducted at the same conditions as before with 100% $N_2$ as carrier gas. For each of the temperature conditions studied, a new set of catalyst and feed mixture was prepared and used.

Tables 3 and 4 below summarize the experimental findings, where all study used a mixed plastic feed and spent FCC (62.50 wt %)+ZSM-5 zeolite catalyst (37.5 wt %) as the pyrolysis catalyst.

TABLE 3

Mixed plastic feed and yield.

| | Hydro-pyrolysis 1 | Pyrolysis 1 | Hydro-pyrolysis 2 | Pyrolysis 2 | Hydro-pyrolysis 3 | Pyrolysis 3 |
|---|---|---|---|---|---|---|
| Feed Weight Transferred, g | 1.50 | 1.50 | 1.50 | 1.50 | 1.50 | 1.50 |
| Bone-Dry Catalyst Feed, g | 9.05 | 8.95 | 9.05 | 9.05 | 9.01 | 8.95 |
| C/F ratio, g/g | 6.03 | 6.0 | 6.03 | 6.03 | 6.00 | 6.0 |
| Reaction Start Temperature, ° C. | 600 | 600 | 635 | 635 | 670 | 670 |
| 1 min Avg. Reactor Bed Temperature, ° C. | 482 | 472 | 525 | 525 | 567 | 570 |
| Yield, wt %, based on $H_2$-free product | | | | | | |
| Methane | 0.92 | 0.40 | 1.00 | 0.56 | 3.20 | 0.99 |
| Ethane | 0.87 | 0.43 | 0.73 | 0.52 | 0.69 | 0.74 |
| Ethylene | 6.17 | 3.68 | 6.50 | 5.07 | 6.36 | 5.78 |
| Carbon Dioxide | 1.29 | 1.63 | 1.54 | 1.93 | 1.85 | 1.91 |
| Propane | 3.90 | 4.26 | 3.15 | 3.58 | 3.11 | 3.49 |
| Propylene | 12.76 | 11.05 | 13.63 | 12.93 | 14.67 | 14.75 |
| i-Butane | 4.56 | 4.99 | 3.85 | 4.75 | 3.77 | 3.53 |
| n-Butane | 2.67 | 1.84 | 2.07 | 1.57 | 1.31 | 1.41 |
| t-2-Butene | 3.16 | 2.67 | 3.10 | 2.89 | 2.99 | 3.01 |
| 1-Butene | 1.75 | 1.63 | 1.79 | 1.79 | 1.90 | 2.01 |
| i-Butylene | 4.68 | 4.55 | 4.56 | 4.76 | 4.72 | 4.97 |
| c-2-Butene | 2.22 | 1.92 | 2.19 | 2.09 | 2.14 | 2.21 |
| Carbon Monoxide | 1.25 | 0.10 | 0.35 | 0.00 | 0.80 | 0.25 |
| Gasoline | 43.83 | 45.34 | 41.66 | 42.42 | 42.11 | 49.30 |
| Diesel | 5.75 | 9.14 | 7.55 | 8.37 | 4.73 | 5.16 |
| Heavies | 0.56 | 1.64 | 0.78 | 0.88 | 0.49 | 0.86 |
| Coke | 4.67 | 4.73 | 5.55 | 5.88 | 5.12 | 5.64 |

Overall, the yield of gas products has increased and liquid products have decreased indicating higher conversions to lighter products.

TABLE 4

Mixed plastics and yield continued.

| | Hydro-pyrolysis 1 | Pyrolysis 1 | Hydro-pyrolysis 2 | Pyrolysis 2 | Hydro-pyrolysis 3 | Pyrolysis 3 |
|---|---|---|---|---|---|---|
| $C_1$-$C_4$ Yield, wt % | 45.2 | 39.1 | 44.5 | 42.5 | 47.5 | 45.0 |
| Liquid Yield, wt % | 50.1 | 56.1 | 50.0 | 51.7 | 47.3 | 49.3 |
| Coke Yield, wt % | 4.7 | 4.7 | 5.6 | 5.9 | 5.1 | 5.6 |

As can be seen, the yield of light gas olefins per unit amount of coke deposited on the catalyst is higher in the case of hydropyrolysis. This implies that more light gas olefins would be produced in a circulating fluid catalytic cracking type of unit. In these units, performance is compared on a constant coke yield basis. This is because the amount of coke burnt off in the regenerator is limited by the air availability in the regenerator and as a result the regenerated catalyst returned back to the riser would have more or less coke on it which would in turn affect its activity in the riser.

The total aromatics as well as $C_6$-$C_8$ aromatics yield per unit amount of coke deposited is also higher in the case of hydropyrolysis. This implies in hydropyrolysis more aromatic products would be produced in a circulating fluid catalytic cracking type of unit as compared to pyrolysis conducted in the same unit. Results are presented in table 5.

TABLE 5

| Mixed plastics and $C_6$-$C_8$ aromatic yield. | | | | | | |
|---|---|---|---|---|---|---|
| | Hydro-pyrolysis 1 | Pyrolysis 1 | Hydro-pyrolysis 2 | Pyrolysis 2 | Hydro-pyrolysis 3 | Pyrolysis 3 |
| Total Aromatics Yield Boiling Below 240° C., wt % | 32.42 | 31.39 | 32.81 | 31.83 | 35.09 | 32.35 |
| $C_6$-$C_8$ Aromatics Yield, wt % | 23.81 | 23.20 | 24.44 | 22.63 | 26.33 | 22.87 |
| Total Aromatics/Coke, wt ratio | 6.9 | 6.6 | 5.9 | 5.4 | 6.9 | 5.7 |
| ($C_6$-$C_8$ Aromatics)/Coke, wt ratio | 5.1 | 4.9 | 4.4 | 3.9 | 5.1 | 4.1 |
| Light gas olefins/Coke, wt ratio | 6.6 | 5.4 | 5.7 | 5.0 | 6.4 | 5.8 |

To summarize, more high value chemicals (i.e. light gas olefins and aromatics) are produced in hydropyrolysis as compared to pyrolysis done without use of hydrogen carrier gas. See table 6.

TABLE 6

| C2-C4 olefins and total olefins. | | | | | | |
|---|---|---|---|---|---|---|
| | Hydro-pyrolysis 1 | Pyrolysis 1 | Hydro-pyrolysis 2 | Pyrolysis 2 | Hydro-pyrolysis 3 | Pyrolysis 3 |
| $C_4$ Olefins, wt % | 11.81 | 10.76 | 11.64 | 11.54 | 11.77 | 12.20 |
| $C_3$ Olefins, wt % | 12.76 | 11.05 | 13.63 | 12.93 | 14.67 | 14.75 |
| $C_2$ Olefins, wt % | 6.17 | 3.68 | 6.50 | 5.07 | 6.36 | 5.78 |
| Total Olefins, wt % | 30.74 | 25.49 | 31.77 | 29.54 | 32.80 | 32.72 |

Additional benefits include: increased olefinicity of product gases; increased ratio of propylene/propane as compared to ethylene to ethane and butenes/butanes; lower hydrogen transfer index (i.e. ratio of $C_3$ and $C_4$ saturates/$C_3$ olefins) in hydropyrolysis as compared to use of nitrogen only as carrier gas; and more $C_4$ iso-olefins are produced in as compared to 1-butene in hydropyrolysis (i.e. isomerization index is lower) as presented in Table 7.

TABLE 7

| Hydrogen Transfer Index and saturated hydrocarbons. | | | | | | |
|---|---|---|---|---|---|---|
| | Hydro-pyrolysis 1 | Pyrolysis 1 | Hydro-pyrolysis 2 | Pyrolysis 2 | Hydro-pyrolysis 3 | Pyrolysis 3 |
| Hydrogen Transfer Index (HTI) | 0.87 | 1.00 | 0.67 | 0.77 | 0.56 | 0.57 |
| Isomerization Coefficient | 0.174 | 0.178 | 0.182 | 0.184 | 0.192 | 0.197 |
| $C_2$ Olefin/$C_2$ Saturated Hydrocarbon | 7.1 | 8.6 | 8.9 | 9.8 | 9.2 | 7.9 |
| $C_3$ Olefin/$C_3$ Saturated Hydrocarbon | 3.3 | 2.6 | 4.3 | 3.6 | 4.7 | 4.2 |
| $C_4$ Olefin/$C_4$ Saturated Hydrocarbon | 1.6 | 1.6 | 2.0 | 1.8 | 2.3 | 2.5 |
| % of i-$C_4$/Total $C_4$ | 23.9 | 28.4 | 21.9 | 26.6 | 22.4 | 20.6 |
| % of Olefins/Total Gases | 68.0 | 65.1 | 71.5 | 69.6 | 69.0 | 72.6 |
| % Olefins/% Saturated Hydrocarbons | 2.6 | 2.2 | 3.2 | 2.8 | 3.7 | 3.6 |

A Detailed hydrocarbon analysis (DHA) of liquid products below 240° C. is also presented in Table 8.

TABLE 8

DHA of liquid products below 240° C.

| | Hydro-pyrolysis 1 | Pyrolysis 1 | Hydro-pyrolysis 2 | Pyrolysis 2 | Hydro-pyrolysis 3 | Pyrolysis 3 |
|---|---|---|---|---|---|---|
| Paraffins, wt % | 1.184 | 1.435 | 1.207 | 1.170 | 1.108 | 1.420 |
| i-Paraffins, wt % | 10.161 | 12.389 | 9.598 | 12.120 | 8.545 | 13.330 |
| Olefins, wt % | 2.944 | 9.159 | 2.555 | 4.858 | 0.976 | 3.900 |
| Naphthenes, wt % | 3.727 | 5.390 | 3.135 | 3.867 | 2.329 | 4.030 |
| Aromatics, wt % | 73.968 | 69.233 | 78.758 | 75.037 | 83.315 | 74.720 |
| BTX + EX content in liquid boiling below 240° C. | 54.32 | 51.17 | 58.67 | 53.35 | 62.52 | 52.81 |

Example 3

Example 3 shows a low severity pyrolysis operation. The experimental set up consisted of a stainless steel reactor pot followed by a fixed bed (tubular) reactor packed with ZSM-5 zeolite extrudates and the outlet of this tubular reactor was connected to a stainless steel condenser/receiver tank. The reactor pot was heated using heating tapes with temperature controller. An amount of 100 g of mixed plastic as per composition provided in Example 1 was charged along with ZSM-5 zeolite catalyst powder of 75 microns average particle size into the reactor and the heating was started. The reactor temperature was maintained constant at 450° C. for a period of 1 hr. The effluent from this reactor pot was continuously passed through the hot tubular reactor packed with ZSM-5 extrudates and maintained at 450° C. The product from the tubular reactor was sent to the receiver. The outgoing gas from the receiver was passed through NaOH scrubber and then diluted with $N_2$ and vented out through a carbon bed. Two different catalyst loadings were tested as below:

Experiment 1: Equivalent to 5 wt % of the feed was the catalyst charged in the tubular reactor and 5 wt % equivalent catalyst was charged in the reactor pot (i.e. 10 wt % of catalyst overall).

Experiment 2: Equivalent to 5 wt % of the feed was the catalyst charged in the tubular reactor and 15 wt % equivalent catalyst was charged in the reactor pot (i.e. 20 wt % catalyst overall).

FIG. 2 shows the boiling point distribution of the liquid product obtained indicated that 95 wt % of the liquid product boiled below 370° C.

The DHA analysis of the liquid product boiling below 240° C. indicated significant presence of olefins and aromatics and is presented in Table 9.

TABLE 9

DHA analysis of the liquid product boiling below 240° C.

| Product Composition | Liquid Product boiling below 240° C. from Experiment 1, wt % | Liquid Product boiling below 240° C. from Experiment 2, wt % |
|---|---|---|
| Paraffins | 6.5 | 3.1 |
| i-Paraffins | 17.6 | 11.7 |
| Olefins | 11.4 | 7.4 |
| Naphthenes | 3.8 | 2.5 |
| Aromatics | 47.9 | 66.3 |

TABLE 9-continued

DHA analysis of the liquid product boiling below 240° C.

| Product Composition | Liquid Product boiling below 240° C. from Experiment 1, wt % | Liquid Product boiling below 240° C. from Experiment 2, wt % |
|---|---|---|
| Heavies | 3.1 | 3.6 |
| Unknown | 9.8 | 5.5 |

Example 4

Example 4 demonstrates a low severity pyrolysis with PVC present in the feed. An amount of 100 g of mixed plastic feed as per the composition provided in Example 1 above was mixed with 2 wt % of ZSM-5 zeolite catalyst powder and heated in a round bottom flask fitted with a condenser. The round bottom flask was maintained at 360° C. for 1 hour. The liquid product had 60 ppmw chlorides. A similar experiment conducted with head space purging of the round bottom flask with $N_2$ gas provided a liquid product with no detectable chloride content. Chloride content in the liquid products was determined by fusing liquid products in NaOH followed by extraction in water and measurement of the resultant aqueous solution chloride content using ion chromatography. This example also demonstrates the possibility of head space purging in a pyrolysis unit to enhance dechlorination.

Example 5

Example 5 demonstrates a low severity pyrolysis process in a fluidized bed. An amount of 1.5 g of mixed plastic feed as per composition provided in Example 1 was mixed with 9.05 g of a catalyst mixture containing 62.5 wt % of FCC spent catalyst and 37.5 wt % of ZSM-5 Zeolite catalyst. This combined mixture was charged into the fluidized bed reactor described in Example 1. Before charging of feed and catalyst mixture the reactor was at a temperature of 450° C. The reactor temperature decreased as the feed was charged and later increased to the set point of 450° C. Data provided below also captures the temperature profile in the reactor bed as a function of time. The 1 minute (min), 6 min, and 10 min average bed temperatures were 333° C., 369° C., and 395° C., respectively. The 1 min average represents the average reaction temperature severity when most temperature changes occur in the reactor. The 6 min average represents the temperature severity when the reactor temperature has recovered and reached the previously set value.

Most of the conversion in the low severity case was expected to have been completed at the 6 min average. The data below shows that the liquid product is highly aromatic, the heavier than 370° C. boiling material is only about 2 wt %, and more than 90 wt % of the liquid product boils below 350° C.

The product yield data is shown in the table 10.

TABLE 10

Product yield.

| | Amount, wt % |
|---|---|
| $H_2$ | 0.03 |
| Methane | 0.00 |
| Ethane | 0.00 |
| Ethylene | 2.25 |
| Carbon Dioxide | 1.54 |
| Propane | 3.39 |
| Propylene | 6.92 |
| i-Butane | 6.48 |
| n-Butane | 1.67 |
| t-2-Butene | 1.71 |
| 1-Butene | 1.04 |
| i-Butylene | 3.37 |
| c-2-Butene | 1.26 |
| Carbon Monoxide | 0.00 |
| Gasoline | 45.28 |
| Diesel | 17.64 |
| Heavies | 2.08 |
| Coke | 5.33 |

The boiling point distribution is presented in Table 11.

TABLE 11

Boiling point distribution.

| Mass % | Boiling Point, ° C. |
|---|---|
| 0.0 | 108.6 |
| 5.0 | 156.0 |
| 10.0 | 164.0 |
| 15.0 | 175.6 |
| 20.0 | 180.0 |
| 25.0 | 187.6 |
| 30.0 | 190.2 |
| 35.0 | 198.8 |
| 40.0 | 203.6 |
| 45.0 | 209.2 |
| 50.0 | 220.2 |
| 55.0 | 227.0 |
| 60.0 | 232.0 |
| 65.0 | 246.0 |
| 70.0 | 254.2 |
| 75.0 | 267.4 |
| 80.0 | 281.8 |
| 85.0 | 300.6 |
| 90.0 | 332.0 |
| 95.0 | 371.6 |
| 99.0 | 431.2 |
| 100.0 | 454.2 |

The DHA of the liquid product is shown in Table 12.

TABLE 12

DHA of the liquid product.

| Carbon No. | n-Paraffins, wt % | i-Paraffins, wt % | Olefins, wt % | Naphthenes, wt % | Aromatics, wt % | Total, wt % |
|---|---|---|---|---|---|---|
| 3 | | | 0.003 | | | 0.003 |
| 4 | 0.007 | 0.012 | 0.041 | | | 0.06 |
| 5 | 0.032 | 0.077 | 0.325 | 0.095 | | 0.529 |
| 6 | 0.173 | 0.566 | 1.025 | 1.009 | 4.757 | 7.53 |
| 7 | 0.379 | 1.379 | 1.547 | 2.095 | 19.393 | 24.793 |
| 8 | 0.398 | 2.443 | 0.198 | 1.518 | 28.466 | 33.023 |
| 9 | 0.046 | 1.911 | 0.134 | 0.958 | 11.254 | 14.303 |
| 10 | 0.019 | 0.916 | 0.02 | 0.156 | 4.448 | 5.559 |
| 11 | 0.022 | 2.114 | | 0.029 | 1.621 | 3.786 |
| 12 | 0.029 | 0.199 | | 0.057 | 3.884 | 4.169 |
| 13 | | 0.078 | 0.111 | | | 0.189 |
| Unknown | | | | | | 2.842 |
| Heavies | | | | | | 3.214 |
| Total, wt % | 1.105 | 9.695 | 3.404 | 5.917 | 78.823 | 93.944 |
| Total, wt % on Aromatics-Free Basis | 5.49 | 48.18 | 16.92 | 29.41 | | |

Examples 6-9

Hydrocracking Examples

Hydrocracking studies (e.g., a study of the reactions present in the second stage of the integrated process) were conducted in a fixed bed reactor located inside a 3-zone split-tube furnace. The reactor internal diameter was 13.8 millimeter (mm) and had concentrically located bed thermowell of 3 mm outer diameter. The reactor was 48.6 cm long. Commercial CoMo catalyst on alumina (8 g bone dry weight) was broken along the length to particles of 1.5 mm long and diluted with silicon carbide SiC in the ratio of 60% SiC to 40% catalyst to give a mean particle diameter of 0.34 mm. This was done to avoid slip through of the chlorides due to wall slip or channeling in the small diameter reactor. Pre-heating bed and post-catalyst inert beds was provided in the form of 1 mm glass beads. The catalyst bed temperature was controlled to isothermal by varying the controlled furnace zone skin temperatures. Liquid feed was fed through a metering pump and $H_2$ gas was fed using a mass flow controller. The reactor effluent gases were cooled to condense out the liquids under pressure, following which the pressure was reduced and effluent gas flow was measured using a drum-type wet gas meter. The gas products were analyzed using a refinery gas analyzer (a custom gas analyzer from M/s AC Analyticals BV). The liquid product olefin content was determined using a detailed hydrocarbon analyzer (DHA) gas chromatography GC and a boiling point characterization was obtained using a SIMDIS GC. The liquid product chloride content was measured using a Chlora M-series analyzer (monochromatic wavelength dispersive X-ray Fluorescence technique, ASTM D7536).

Example 6

A hydrocarbon feed mixture was prepared to contain 30 wt % n-hexadecane, 10 wt % i-octane, 20 wt % 1-decene, 20 wt % cyclohexane and 20 wt % ethyl benzene. To this were added dimethyl disulphide, 2-chloropentane, 3-chloro-3-methyl pentane, 1-chlorohexane, (2-chloroethyl) benzene and chlorobenzene to give 205 ppm organic chlorides and 2 wt % sulfur S in the mixture. This combined feed mixture was treated with $H_2$ in the packed bed reactor as above at conditions of 280° C. reactor temperature, 60 barg (gauge pressure) reactor pressure, 1 hr-1 weight hourly space velocity WHSV and 400 Normal liter per liter NL/L $H_2$/HC flow ratio. The liquid product was analyzed in a DHA wherein molecules lighter than C13 are injected into the GC column and heavier than C13 are flushed out. The normalized composition of liquid product as measured by DHA was Paraffins (26.24 wt %), paraffins (17.28 wt %), olefins (0 wt %), naphthenes (33.61 wt %), aromatics (22.88 wt %). SIMDIS analysis of liquid products indicates that 78 wt % of the product liquid boils at 180° C. and immediately at 79 wt % the boiling point shifts to 286° C. indicating that 22 wt % (i.e. 100-78=22) of the liquid product is hexadecane. This implies out of 30 wt % hexadecane in feed, 8 wt % (on feed basis) of hexadecane was hydrocracked to lower products. As mentioned before this 22 wt % does not get analyzed in DHA. This 22 wt % hexadecane unaccounted in DHA composition is added to the liquid product analyzed by DHA (DHA composition multiplied by 0.78 fraction that was injected into DHA) and the resulting composition of liquid products is 42.47 wt % paraffins, 13.48 wt % i-paraffins, 0 wt % olefins, 26.21 wt % naphthenes and 17.84 wt % aromatics. Hence, comparing feed and liquid product compositions, it can be the that paraffins, isoparaffins and naphthenes have increased while aromatics have reduced and olefins were completely depleted. This clearly indicates hydrocracking of hexadecane as well as hydrocracking of olefins in feed. In addition, the chloride content of the liquid product was 0.09 ppmw. Thus hydrocracking, olefin depletion and dechlorination have simultaneously occurred (e.g., in the second stage of the integrated process described herein).

Example 7

A hydrocarbon feed mixture was prepared to contain 30 wt % n-hexadecane, 10 wt % i-octane, 20 wt % 1-decene, 20 wt % cyclohexane and 20 wt % ethyl benzene. To this were added dimethyl disulphide, 2-chloropentane, 3-chloro-3-methyl pentane, 1-chlorohexane, (2-chloroethyl) benzene and chlorobenzene to give 205 ppm organic chlorides and 2 wt % S in the mixture. This combined feed mixture was treated with $H_2$ in the packed bed reactor as above at conditions of 300° C. reactor temperature, 1 hr-1 WHSV and 400 NL/L $H_2$/HC flow ratio. Three different pressure conditions were studied: 10 barg, 20 barg and 60 barg. The liquid products were analyzed using simulated distillation (SIMDIS). The results as provided in Table 13 below indicate that 20 wt % or less of the products boil in the hexadecane boiling point range. In contrast, feed contained 30 wt % hexadecane. Hence, at all pressures, hydrocracking is demonstrated.

TABLE 13

Analysis of liquid products at different pressure conditions.

| Cut, wt % | Temp ° C., 60 barg | Temp ° C., 20 barg | Temp ° C., 10 barg |
|---|---|---|---|
| 0 | 61.4 | 52 | 61.4 |
| 5 | 72 | 61.4 | 72 |
| 10 | 72 | 72 | 72 |
| 15 | 72 | 72 | 72 |
| 20 | 72 | 72 | 72 |
| 25 | 72 | 72 | 72 |
| 30 | 87.6 | 72 | 72 |
| 35 | 87.6 | 72 | 87.6 |
| 40 | 87.6 | 87.6 | 87.6 |
| 45 | 87.6 | 87.6 | 132 |
| 50 | 87.6 | 134.6 | 137.2 |
| 55 | 129.4 | 137.2 | 139.8 |
| 60 | 134.6 | 139.8 | 139.8 |
| 65 | 139.8 | 142.4 | 161.2 |
| 70 | 170.6 | 163.2 | 173.8 |
| 75 | 176 | 175.4 | 177 |
| 80 | 177.6 | 180.6 | 271.6 |
| 85 | 289.2 | 279.6 | 288.2 |
| 90 | 292 | 291 | 291.6 |
| 95 | 294 | 294.6 | 294 |
| 99 | 295.4 | 296.8 | 295.4 |
| 100 | 295.6 | 297 | 295.6 |

The corresponding chloride contents of liquid product at 60 barg, 20 barg and 10 barg were respectively 0.11 ppm, 0.09 ppm and 0.12 ppm.

Example 8

A hydrocarbon feed mixture was prepared to contain 30 wt % n-hexadecane, 10 wt % i-octane, 20 wt % 1-decene, 20 wt % cyclohexane and 20 wt % ethyl benzene. To this the organic chlorides mentioned in example 7 above was added along with dimethyl disulphide to give 205 ppm organic chlorides and 2 wt % S in the mixture. This combined feed mixture was treated with $H_2$ in the packed bed reactor as above at conditions of 260° C. reactor temperature, 60 barg reactor pressure, 1 hr-1 WHSV and 400 NL/L $H_2$/HC flow ratio. The liquid product contained 0.1 ppm chloride. This demonstrates the effective removal of chloride at very low temperatures.

Example 9

A plastic pyrolysis oil (36.3 g) was mixed with n-hexadecane (240 g) and to this was added dimethyl disulphide and 1-chlorohexane to give 2.34 wt % sulfur and 836 ppm chloride Cl in the combined feed. This feed was treated with $H_2$ in a packed bed reactor as mentioned above under several operating conditions as provided in the table below. $H_2$/HC is hydrogen to hydrocarbon ration. Results are presented in Table 14.

TABLE 14

Chloride content.

| Temperature ° C. | P, barg | WHSV, $Hr^{-1}$ | $H_2$/HC, NL/L | Cl, ppm in liquid product |
|---|---|---|---|---|
| 300 | 60 | 1 | 400 | 0.32 |
| 300 | 40 | 1 | 400 | 0.87 |
| 350 | 40 | 1 | 400 | 3.42 |
| 400 | 40 | 1 | 400 | 3.15 |

As can be seen from the above table, chloride in liquid product increases when reactor bed temperature is increased to at or above 350° C.

Example 10

Example 10 demonstrates how a steam cracker is used in combination with pyrolysis and hydroprocessing unit. Gases ($C_1$-$C_4$) from a pyrolysis unit and hydroprocessing facility are fed to gas crackers. Liquids from the hydroprocessing facility are fed to liquid steam crackers.

Gas steam cracking of a feed consisting of 16.75 wt % ethane, 34.62 wt % propane, 27.62 wt % isobutene and 21 wt % butane, carried out at a steam cracker coil outlet temperature of 840° C., a steam/hydrocarbon ratio of 0.35, and a coil outlet pressure of 1.7 bar, resulted in a product having 0.48 wt % acetylene, 34.1 wt % ethylene, 12.21 wt % propylene, and 2.41 wt % butadiene, among other products.

Steam cracking a naphtha feed (boiling cut from initial boiling point to 220° C.) having 20.3 wt % paraffin, 27.9 wt % i-paraffins, 14.5 wt % aromatics, and 36.9 wt % naphthenes at a coil outlet temperature of 865° C., a coil outlet pressure of 1.7 bar, and a steam to oil ratio of 0.5 resulted in a product having 25.86 wt % ethylene, 12.14 wt % propylene, and 4.98 wt % butadiene.

Steam cracking of gas oils (greater than 220° C. boiling point to 380° C.) resulted in a product having 24 wt % ethylene, 14.45 wt % propylene, 4.7 wt % butadiene, and 4.5 wt % butenes.

What is claimed:

1. A method of producing pyrolysis products from a mixed plastics stream, the method comprising:

(a) conducting pyrolysis of a plastic feedstock to produce a first stream comprising C1-C4 gaseous hydrocarbons and light gas olefins and a second stream comprising hydrocarbons having 5 or more carbon atoms, wherein at least a portion of the plastic feedstock comprises chlorinated plastic;

(b) feeding the second stream and hydrogen gas into a hydrocracker to produce a third stream comprising gaseous C1-C4 hydrocarbon gases and a fourth stream comprising hydrocarbons having 5 or more carbon atoms; and (c) feeding the fourth stream to:

i. a steam cracker to produce a fifth stream comprising C1-C4 gaseous hydrocarbons and light gas olefins, a sixth stream comprising C5-C8 hydrocarbons and a seventh stream comprising hydrocarbons having 8 or more carbon atoms; and ii. a fluidized catalytic cracker to produce an eighth stream comprising C1-C4 gases and light gas olefins, and a ninth stream comprising hydrocarbons having 5 or more carbon atoms, wherein the feeding the fourth stream further comprises feeding the fourth stream to a distillation column, wherein the distillation column supplies a bottom stream comprising hydrocarbons heavier than C8 to the fluidized catalytic cracker, the fluidized catalytic cracker producing a C1-C4 gaseous hydrocarbon stream and light gas olefins and a stream comprising hydrocarbons having 5 or more carbon atoms, the stream comprising hydrocarbons having 5 or more carbon atoms being recycled to the hydrocracker, and wherein the distillation column supplies a top stream comprising hydrocarbons that have 8 or fewer carbon atoms to the steam cracker, the steam cracker producing the fifth stream, the sixth stream, and the seventh stream.

2. The method of claim 1, wherein the ninth stream is being recycled to the hydrocracker.

3. The method of claim 1, wherein the ninth stream is being supplied to a hydrogenation reactor to produce a tenth stream comprising hydrogenated product, the hydrogenated product being supplied to an aromatic extraction unit to produce a C6-C8 aromatics stream and a stream comprising hydrocarbons having at least 9 carbon atoms that is recycled to the hydrocracker.

4. The method of claim 1, wherein the mixed plastic stream comprises at least one of polyolefins, polystyrene, polyethylene terephthalate (PET), polyvinyl chloride (PVC), polyamide, polycarbonate, polyurethane, polyester, natural and synthetic rubber.

5. The method of claim 1, wherein at least one of the first stream, third stream, fifth stream and eighth stream additionally comprises hydrochloric acid (HCl).

6. The method of claim 5, wherein the hydrochloric acid (HCl) is scrubbed from at least one of the first stream, third stream, fifth stream and eighth stream.

7. The method of claim 3, wherein the hydrochloric acid (HCl) is scrubbed via a process of liquid scrubbing and/or reactive adsorption.

8. The method of claim 1, wherein the pyrolysis is performed in the presence of a catalyst at a temperature of 350° C. to 1000° C.

9. The method of claim 1, wherein the hydrocracker is a fixed bed reactor in the presence of a catalyst.

10. The method of claim 1, wherein the fluidized catalytic cracker operates at a temperature of 550° C. or higher, in the presence of a catalyst composition comprising a fluidized catalytic cracking catalyst and a ZSM-5 zeolite catalyst, wherein the ZSM-5 zeolite catalyst makes up at least 10 wt. % of the total weight of the fluidized catalytic cracking catalyst and the ZSM-5 zeolite catalyst, the fourth stream and the catalyst composition being at a catalyst-to-feed stream ratio of from 6 or greater.

11. The method of claim 10, wherein the fluidized catalytic cracking catalyst is comprised of at least one of an X-zeolite, a Y-zeolite, a USY-zeolite, mordenite, faujasite, nano-crystalline zeolites, MCM mesoporous materials, microporous silica, a silico-alumino phosphate, a gallophosphate, and a titanophosphate.

12. The method of claim 1, wherein fourth stream contains 10 ppmw or less of chloride when fed to the steam cracker.

13. The method of claim 1, wherein the mixed plastic stream comprises at least 1000 ppmw of chloride.

14. The method of claim 1, wherein at least one of the sixth and ninth streams comprises less than 1 ppmw of chloride.

* * * * *